US008107802B2

(12) United States Patent
Hollis

(10) Patent No.: US 8,107,802 B2
(45) Date of Patent: Jan. 31, 2012

(54) TANKLESS ELECTRIC WATER HEATER WITH EFFICIENT THERMAL TRANSFER

(76) Inventor: Jeremy Lee Hollis, Cayucas, CA (US)

( * ) Notice: Subject to any disclaimer, the term of this patent is extended or adjusted under 35 U.S.C. 154(b) by 414 days.

(21) Appl. No.: 12/479,538

(22) Filed: Jun. 5, 2009

(65) Prior Publication Data

US 2010/0310241 A1 Dec. 9, 2010

(51) Int. Cl.
*H05B 3/78* (2006.01)
*B67D 7/80* (2010.01)

(52) U.S. Cl. ..... 392/488; 392/465

(58) Field of Classification Search ..... 392/465–496
See application file for complete search history.

(56) References Cited

U.S. PATENT DOCUMENTS

| | | | | |
|---|---|---|---|---|
| 2,471,674 | A * | 5/1949 | Cote | 392/375 |
| 3,417,227 | A * | 12/1968 | Barbier et al. | 392/358 |
| 3,796,193 | A | 3/1974 | Martin et al. | |
| 3,968,346 | A | 7/1976 | Cooksley | |
| 4,554,906 | A | 11/1985 | Newman, Sr. et al. | |
| 4,562,956 | A | 1/1986 | Check | |
| 4,640,233 | A * | 2/1987 | Draper et al. | 122/488 |
| 4,762,980 | A | 8/1988 | Insley | |
| 4,808,793 | A | 2/1989 | Hurko | |
| 5,271,087 | A * | 12/1993 | Schmid | 392/485 |
| 5,437,003 | A | 7/1995 | Blanco | |
| 5,504,306 | A | 4/1996 | Russell et al. | |
| 5,590,240 | A | 12/1996 | Rezabek | |
| 5,892,887 | A * | 4/1999 | Thomas et al. | 392/490 |
| 6,175,689 | B1 | 1/2001 | Blanco, Jr. | |
| 6,574,426 | B1 | 6/2003 | Blanco, Jr. | |
| 6,684,822 | B1 | 2/2004 | Lieggi | |
| 6,736,329 | B2 | 5/2004 | Doclo | |
| 6,941,756 | B1 | 9/2005 | Lieggi | |
| 7,088,915 | B1 | 8/2006 | Sturm et al. | |
| 7,158,718 | B2 * | 1/2007 | Russegger | 392/488 |

FOREIGN PATENT DOCUMENTS

| | | |
|---|---|---|
| EP | 0279767 A2 | 2/1988 |
| WO | 92/10071 | 6/1992 |

OTHER PUBLICATIONS http://www.gotankless.com/stiebel-tankless-internal-view.html Downloaded Jul. 14, 2008 Stiebel Eltron Tempra tankless water heater features:—Electronic Control Module. http://www.seisco.com/Challenge/sec5.html Downloaded Jul. 14, 2008 SEISCO Tankless Water Heater—SEISCO Provides Highly Responsive Power Control for its Tankless Water Heater.

* cited by examiner

*Primary Examiner* — Daniel L Robinson
(74) *Attorney, Agent, or Firm* — Russ Weinzimmer; Russ Weinzimmer & Associates PC

(57) ABSTRACT

A tankless electric water heater is disclosed that optimizes energy efficiency while minimizing cost and size. A flow-through container surrounds an electric heating element having a surface that is everwhere in direct, unobstructed relationship with the container walls, forming therebetween a passage through which all of the water must pass in a laminar flow while in close proximity to the heater surface, preferably within one-quarter inch and more preferably within one-eighth inch. The entire heater surface is surrounded by water, and all emanated heat must pass into the water. Tubular embodiments can be straight, coiled, U-shaped, and/or S-shaped. Cup-shaped embodiments can direct the water in a counter-flow past inner and outer heating element surfaces. Electrical connectors can be positioned near to each other. Protruding fins can be included that increase heat contact with the water, and the fins can be aligned with the water flow to minimize turbulence.

20 Claims, 6 Drawing Sheets

TANKLESS ELECTRIC WATER HEATER WITH EFFICIENT THERMAL TRANSFER

FIELD OF THE INVENTION

The invention generally relates to water heaters, and more specifically to tankless electric water heaters.

BACKGROUND OF THE INVENTION

Nearly all residential plumbing systems, as well as most commercial plumbing systems, include at least one water heater. Various types of water heater are available, depending on the size and type of plumbing system, on the expected patterns of usage, and on the local costs for various forms of energy.

Many water heating systems include a water storage tank in which heated water is stored until use. Such "tank-based" water heaters are adaptable to almost any form of energy, including oil, gas, and electricity, and can provide high quantities of heated water on demand.

However, tank-based water heaters suffer from several disadvantages. They are generally required to maintain large quantities of water at elevated temperatures for extended periods of time between use, and this wastes energy and money. Tank-based water heaters are typically large, difficult to site, and expensive, so that even very large plumbing systems usually include only a few, or typically only one, tank-based water heater, which is often located in a basement or other non-central location. This means that hot water must be piped over significant distances so as to serve all desired locations in a plumbing system, thereby wasting more energy and money, and requiring users to run the water for several seconds or minutes before hot water arrives.

In addition, a tank-based water heater has a finite water capacity, and can require considerable time to replenish its hot water reservoir once it is exhausted. This can be a major inconvenience for someone who wishes to bathe or otherwise use hot water after the capacity of a tank-based water heater has been exhausted. The situation is even worse if the user is in the process of bathing when the hot water runs out.

Another approach that is popular in many locations throughout the world is to use a tankless water heater that can heat water on demand as it flows through the system. Some tankless water heaters use oil or gas to heat water, but these systems suffer from many of the same disadvantages as tank-based water heaters. They are typically large, difficult to site, and expensive, so that even very large plumbing systems usually include only a few, or typically only one, oil or gas heated tankless water heater, typically located in a basement or other non-central location. As with tank-based water heaters, this means that hot water must be piped over significant distances so as to serve all desired locations in a plumbing system, thereby wasting energy and money and requiring users to wait for arrival of hot water.

Electrically heated tankless water heaters largely avoid the problems cited above. They are relatively small and inexpensive, thereby allowing a plurality of tankless water heaters to be distributed throughout a plumbing system, typically being sited at or near the locations where hot water is used. However, electricity is generally more costly than oil or gas, so it is critical that an electric, tankless water heater use energy as efficiently as possible.

Some electric tankless water heaters include an electric heating element surrounding a pipe or a small chamber through which water flows. The heating element is typically surrounded by thermal insulation in an attempt to minimize heat loss. Nevertheless, at least some of the heat generated by the heating element is inevitably lost to the environment without passing through the water, thereby wasting energy and increasing the operating cost.

In other approaches, the electric heating element is contained within a small flow-through heating chamber, the heating element being typically folded back onto itself within the heating chamber so as to simplify the electrical wiring by placing both ends of the heating element at the same end of the chamber. However, this approach can waste energy due to uneven exposure of different regions of the heating element to the surrounding water.

Some electric tankless water heaters are designed to create turbulence in the water as it flows through the heating chamber, while others are designed to promote laminar water flow. Electric tankless water heaters that are designed to encourage turbulence within the heating chamber provide good thermal contact between all of the water and the heating element, and this improves the energy efficiency. However, the turbulence creates added back-pressure in the plumbing system, which must be overcome by enlarging the cross-sectional flow-through area of the heating chamber, leading to larger water heaters.

Electric tankless water heaters that encourage laminar water flow through the heating chamber provide lower back-pressures, but are generally less energy efficient, because only some of the water is brought into direct contact with the heating element. These units therefore require larger heating elements and correspondingly larger heating chambers.

Furthermore, many electric tankless water heaters, although small, are complex in design and expensive to produce, thereby limiting the number of units that can be deployed in a plumbing system without exceeding the available budget.

SUMMARY OF THE INVENTION

An electrically heated tankless water heater is claimed that provides high energy efficiency and low back-pressure in a compact and simple design that is inexpensive to produce. The claimed tankless water heater includes a heating element located within a flow-through container. Each portion of the surface of the heating element is in a directly facing and physically unobstructed relationship with a corresponding portion of the container walls, creating therebetween a flow passage that the water is required to traverse as it flows through the container.

The entire surface of the heating element is exposed to the water, thereby maximizing the efficiency of heat transfer to the water. All generated heat is forced to flow into the water, thereby minimizing heat loss to the environment. And because most of the flow passage is narrow and unobstructed, all of the water is brought into efficient and direct thermal contact with the surface of the heating element, while at the same time the water is maintained in a laminar flow so as to minimize back-pressure. The heater of the present invention thereby creates a laminar flow of water while at the same time bringing all of the water into efficient and direct thermal contact with the heating element.

The width of the flow passage is selected so as to minimize the volume of water that is heated by each unit portion of the heater element surface, while at the same time providing sufficient flow passage width to avoid undue drag and/or turbulence due to viscous interaction between the water and the boundaries of the flow passage.

Tubular embodiments can be straight, U-shaped, S-shaped, spiral, or any other convenient shape. Some embodiments are cup-shaped in a counter flow configuration, and various embodiments place all electrical contact points close to one another.

The device can be used to heat any flowing liquid or fluid, for example water in a plumbing system, water in a home heating system, heating oil flowing through exterior plumbing in a cold climate, or chemicals being used in an industrial or factory environment. For simplicity of expression, the term "water" is used interchangeably with the word "fluid" throughout this document, but unless otherwise stated the term "water" refers generically to any flowing, heatable liquid or fluid.

One general aspect of the present invention is an apparatus for heating a fluid as the fluid flows through a plumbing system, the plumbing system having a narrowest cross-sectional area. The apparatus includes a flow-through container having an interior bounded by container walls, the flow-through container having an input and an output that are connectable to the plumbing system so as to allow the fluid to flow into the input, through the interior, and out of the output. The apparatus further includes an electrically heated heating element contained within the flow-through container, the electrically heated heating element having a surface, each portion of the surface being in a directly facing and physically unobstructed relationship with a corresponding portion of the container walls, and creating therebetween a flow passage through which the fluid is required to flow in thermal contact with the surface of the electrically heated heating element.

In preferred embodiments, the input and output are connectable to a water plumbing system. In some embodiments the heating element has a proximal electrical connector at a proximal end of the heating element and a distal electrical connector at a distal end of the heating element, and the apparatus deviates from a linear configuration so as to position the proximal and distal ends closer to each other than the connectors would be if the apparatus were linear.

In various preferred embodiments the space through which the flow passage has a width of not more than one-quarter inch. And in other preferred embodiments the flow passage has a width of not more than one-eighth inch.

In preferred embodiments, the flow-through container is configured as a hollow tube, and the heating element is configured as a rod centered concentrically within the hollow tube. In some of these preferred embodiments at least one section of the hollow tube is straight, U-shaped, S-shaped, or coiled.

In certain preferred embodiments, the electrically heated heating element is substantially cup-shaped, having an inner surface and an outer surface, and the flow-through container surrounds the heating element so as to form a counter-flow configuration that causes the fluid to flow in opposite directions along the inner and outer surfaces of the electrically heated heating element.

Preferred embodiments further include protrusions that extend outward from the heating element so as to increase thermal contact between the heating element and the fluid as the fluid flows through the flow-through container. And in some of these embodiments the protrusions are aligned with the fluid flow so as to minimize turbulence in the fluid flow.

In various preferred embodiments the minimum cross sectional area of the flow passage is at least equal to the minimum cross-sectional area of the plumbing system.

Another general aspect of the present invention is an apparatus for heating water as the water flows through a plumbing system, the plumbing system having a narrowest cross-sectional area. The apparatus includes a flow-through container having an interior bounded by container walls, the flow-through container having an input and an output that are connectable to the plumbing system so as to allow the water to flow into the input, through the interior, and out of the output. The apparatus further includes an electrically heated heating element contained within the flow-through container, the electrically heated heating element having a surface, each portion of the surface being in a directly facing and physically unobstructed relationship with a corresponding portion of the container walls, and creating therebetween a flow passage through which the water is required to flow in thermal contact with the surface of the electrically heated heating element.

In preferred embodiments, the input and output are connectable to a water plumbing system. In some embodiments the heating element has a proximal electrical connector at a proximal end of the heating element and a distal electrical connector at a distal end of the heating element, and the apparatus deviates from a linear configuration so as to position the proximal and distal ends closer to each other than the connectors would be if the apparatus were linear.

In various preferred embodiments the space through which the flow passage has a width of not more than one-quarter inch. And in other preferred embodiments the flow passage has a width of not more than one-eighth inch.

In preferred embodiments, the flow-through container is configured as a hollow tube, and the heating element is configured as a rod centered concentrically within the hollow tube. In some of these preferred embodiments at least one section of the hollow tube is straight, U-shaped, S-shaped, or coiled.

In certain preferred embodiments, the electrically heated heating element is substantially cup-shaped, having an inner surface and an outer surface, and the flow-through container surrounds the heating element so as to form a counter-flow configuration that causes the water to flow in opposite directions along the inner and outer surfaces of the electrically heated heating element.

Preferred embodiments further include protrusions that extend outward from the heating element so as to increase thermal contact between the heating element and the water as the water flows through the flow-through container. And in some of these embodiments the protrusions are aligned with the water flow so as to minimize turbulence in the water flow.

In various preferred embodiments the minimum cross sectional area of the flow passage is at least equal to the minimum cross-sectional area of the plumbing system.

BRIEF DESCRIPTION OF THE DRAWINGS

The invention will be more fully understood by reference to the detailed description, in conjunction with the following figures, wherein.

DETAILED DESCRIPTION OF PREFERRED EMBODIMENTS

Figure 1A:
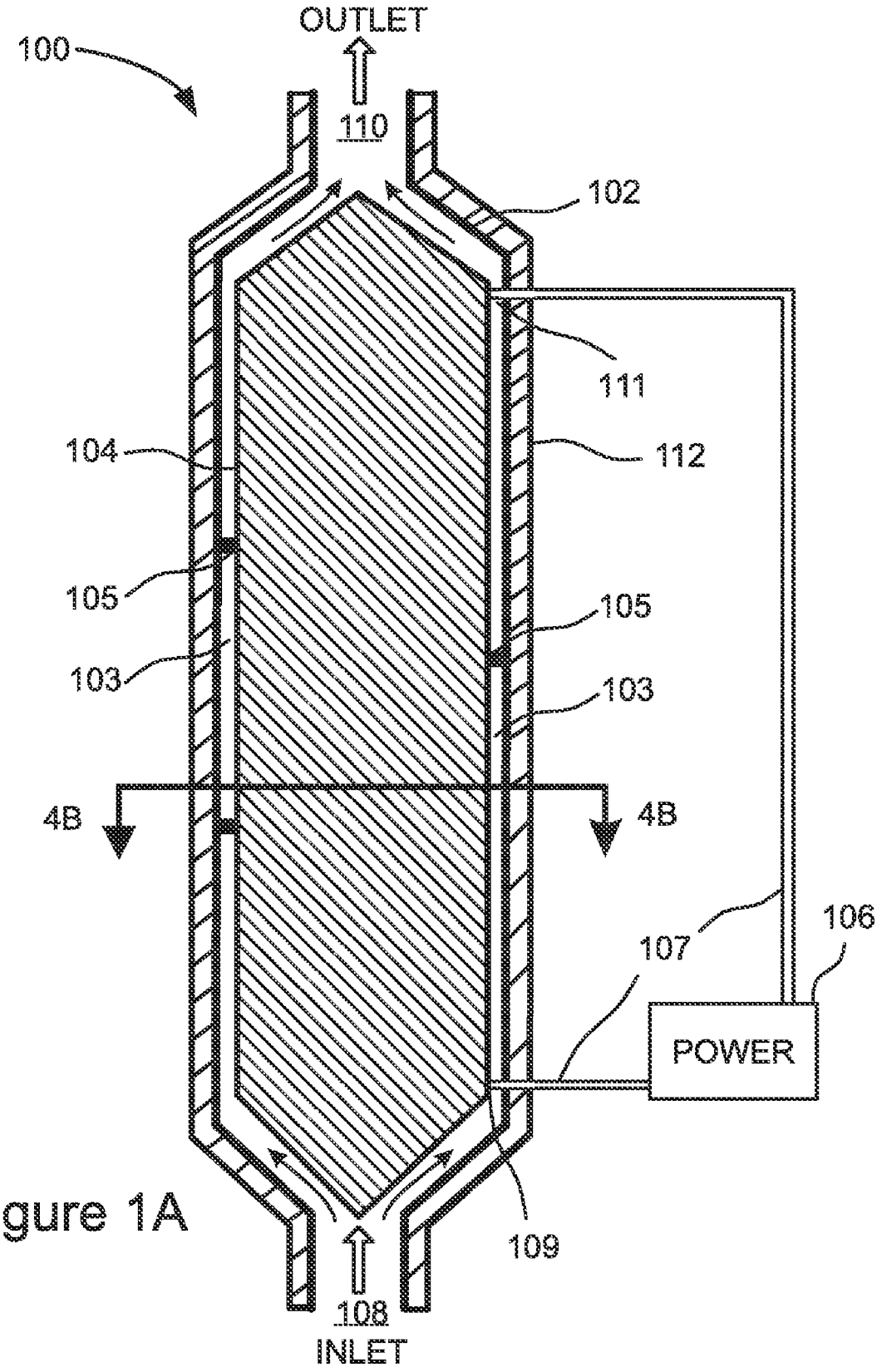
FIG. 1A is a side cross-sectional view of a tankless water heater having a generally straight tubular shape according to an embodiment of the present invention.
Figure 1B:
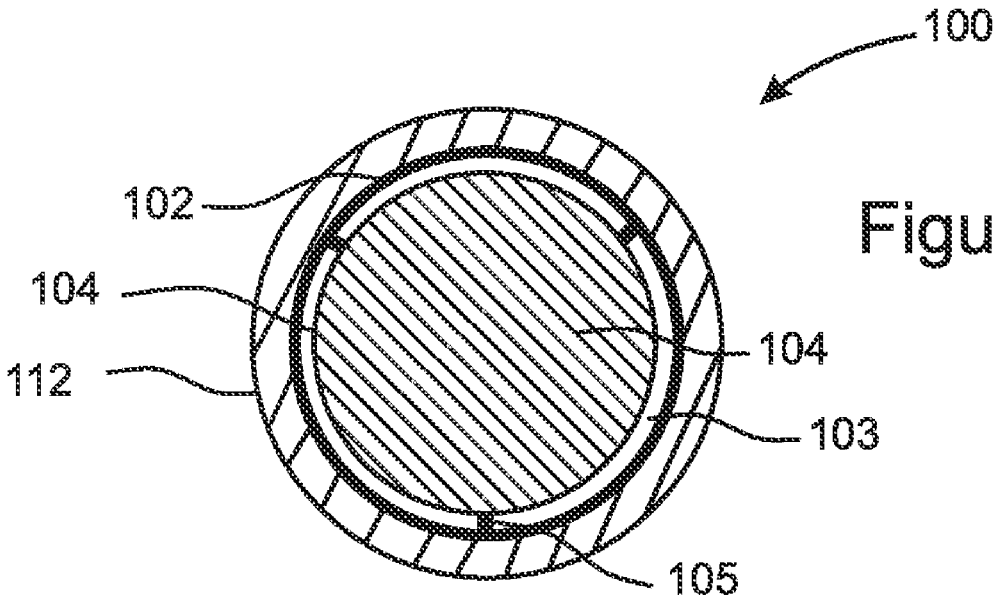
FIG. 1B is a top view of the water heater of FIG. 1A.

With reference to FIGS. 1A and 1B, the present invention is a tankless, electrically powered water heater 100 suitable for heating water or any other flowing, heatable liquid or fluid (herein referred to generically as "water") as it flows through a plumbing system. The tankless water heater 100 includes a flow-through container 102 that serves as a heating chamber, and an electrically heated heating element 104 housed within the interior 103 of the flow-through container 102. The flow-through container 102 includes an input 108 and an output 110 that are connectable to the plumbing system (not shown) so as to allow water to flow into the input 108, through the interior 103, and out of the output 110.

The electrically heated heating element has a surface 104, each portion of which is in a directly facing and physically unobstructed relationship with a corresponding portion of the container walls 102, thereby creating a flow passage 103 through which the water is required to flow while in close and efficient thermal contact with the surface 104 of the electrically heated heating element. The width of the flow passage 103 is narrow enough to minimize the volume of water that must be heated by each unit portion of the heating element surface 104, while at the same time being wide enough to avoid back-pressure and/or turbulence due to viscous drag between the water and the boundaries of the flow passage 103.

In the embodiment of FIG. 1A and FIG. 1B, the container 102 is generally linear and cylindrical, having a hollow, circular cross section, and the electrically heated heating element 104 is shaped as a rod that is positioned concentrically within the container 102 and held in place by a plurality of supports or spacers 105. The surface of the heating element 104 and the inner surface of the container 102 are thereby maintained equidistant from each other along the length of the container 102, and provide a flow passage 103 therebetween. When water flows through the flow passage 103, the entire surface of the heating element 104 is exposed to the water, and all heat generated by the heating element 104 is forced to flow into the water. And because most of the flow passage 103 is narrow and unobstructed, all of the water flowing through the flow passage 103 is brought into thermal contact with the surface of the heating element 104, while at the same time being maintained in a laminar flow so as to minimize back-pressure.

The heating element 104 is operated using an electrical power supply 106 that is coupled to the heating element 104 by a proximal connector 109 and a distal connector 111. The power supply is typically connected to an external power source such as a wall socket. One or more leads 107 connect the power supply 106 to the heating element connectors 109, 111. In the embodiment of FIG. 1A, the connectors 109, 111 are separated by a distance that is nearly equal to the length of the container 102. As is discussed in greater detail below, in other embodiments the container 102 is configured so as to position the connectors 109, 111 close to each other.

In the embodiment of FIG. 1A and FIG. 1B, an insulation layer 112 surrounds the container so as to reduce heat loss from the water along the length of the container 102. While the insulation layer 112 is illustrated in FIGS. 1A and 1B as being on the outer surface of the container 102, it will be appreciated that in other embodiments the insulation layer 112 is on the inner surface of the container 102, and in yet other embodiments an insulation layer is not included.

In operation, water or any other fluid to be heated, flows into the container 102 through the inlet 108. The heating element 104 is energized by the power source 106 so as to generate and emit heat. The fluid traverses the passage 103 in a laminar flow such that the fluid surrounds all surfaces the heating element 104 and all of the fluid is held in close proximity to the heating element. The fluid absorbs heat from the heating element 104 along the length of the container 102, and the heated fluid exits from the outlet 110.

As illustrated in FIG. 1A and FIG. 1B, all of the fluid flowing through the heater 100 is maintained in close proximity to the surface of the heating element 104. In some embodiments, all the fluid flowing through the flow passage 103 is maintained within one-quarter of an inch from the heating element 104. In other embodiments, all of the fluid flowing through the flow passage 103 is maintained within one-eighth of an inch from the heating element 104.

Further, it can be seen from the figures that all of the heat emanating from the heating element 104 necessarily passes through the fluid before any part of the heat escapes from the container 102.

It can also be seen in FIG. 1A that the heating element 104 is not folded back onto itself, but instead every portion of the surface 104 of the heating element is in direct, unobstructed relationship with a corresponding portion of the walls of the container 102, thereby providing uniform exposure of the entire heating element surface to the surrounding water. This provides for efficient delivery to the water of all of the heat generated by the heating element 104.

The tankless water heater 100 is connectable to a plumbing system (not shown). Typically, the inlet 108 and the outlet 110 have cross sectional dimensions similar to that of pipes included in the plumbing system, so that the heater 100 is easily integrated into the plumbing system in a modular fashion. Further, in preferred embodiments, the minimum cross-sectional area of the fluid passage 103 is at least equal to, and preferably larger than, the minimum cross-sectional area of the plumbing system pipe, so as to prevent constriction of the fluid flow. Larger total cross-sectional areas are preferable, since they result in a slower flow of water through the heater 100, and a resultant increase in heating efficiency and hot water flow capacity.

In preferred embodiments, due to its compact size as well as simplicity of design and resultant low cost of manufacture, a plurality of tankless water heaters 100 of the present invention can be located at various points of usage, thereby saving energy by eliminating heat losses during transfer of hot water from a central unit to each point of use. For new construction, this approach also saves material and installation costs, since only a single, cold water plumbing system needs to be installed. For existing construction, the efficient and compact design of the heater 100 makes it suitable for easy installation into an existing plumbing system, and easy maintenance thereafter.

Embodiments typically include a water flow sensor (not shown) that causes the power supply 106 to apply electricity to the heating element 104 only when water is flowing. In some embodiments, a thermostat (not shown) is also included to limit the amount of heating and prevent overheating of the fluid, for example at low water flow rates. In other embodiments, the power supply 106 is automatically activated by another device, such as a light switch, so as to apply electricity to the heating element 104 and prepare for delivery of hot water whenever someone enters the room in which the heater 100 is deployed. Those skilled in the art will readily appreciate that several other techniques for controlling the heating element 104 may be equivalently employed.

Figure 2:
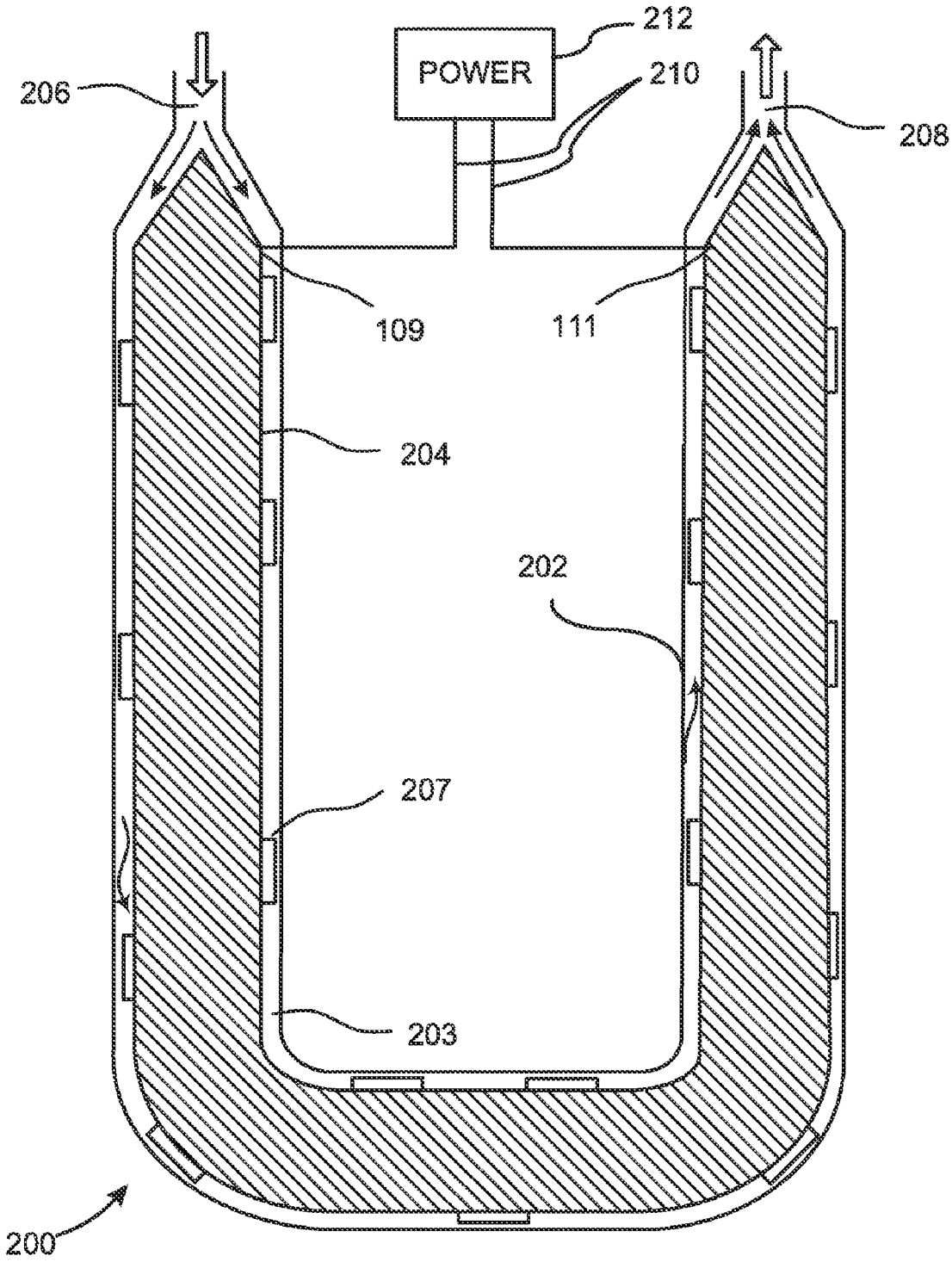
FIG. 2 is a side cross-sectional view of a tankless water heater configured as a U-shaped tube according to another embodiment of the present invention.

FIG. 2 illustrates a preferred embodiment 200 of the present invention that differs from the embodiment of FIG. 1A in that it has an overall U-shape, instead of the straight tubular shape 102 of FIG. 1A. However, the container 202 and heating element 204 contained therein are otherwise similar to the embodiment of FIG. 1A. The U-shaped configuration allows for a lengthier water passage 203 between the inlet 206 and the outlet 208 to be contained within a smaller space, thereby providing increased heat transfer to the fluid from the heating element 204 and a corresponding increase in the fluid heating rate. The U-shape of this embodiment also allows for shorter power conducting leads 210 that connect the heating element connectors 109, 111 to the power supply 212, since the two ends of the heating element 204 are positioned generally nearer to each other than in the case of a straight, tubular configuration such as is illustrated in FIG. 1A and FIG. 1B.

In the embodiment of FIG. 2, the heating element 204 has protrusions in the form of fins 207 that enhance the transfer rate of heat from the heating element 204 to the fluid contained within the container 202. The fins are aligned with the flow of fluid, thereby maintaining laminar flow within the flow passage 203.

For simplicity of illustration, thermal insulation is not shown in FIG. 2 as surrounding the container 202. However, it will be understood that thermal insulation is included in some preferred embodiments that are otherwise identical to the embodiment of FIG. 2.

Figure 3:
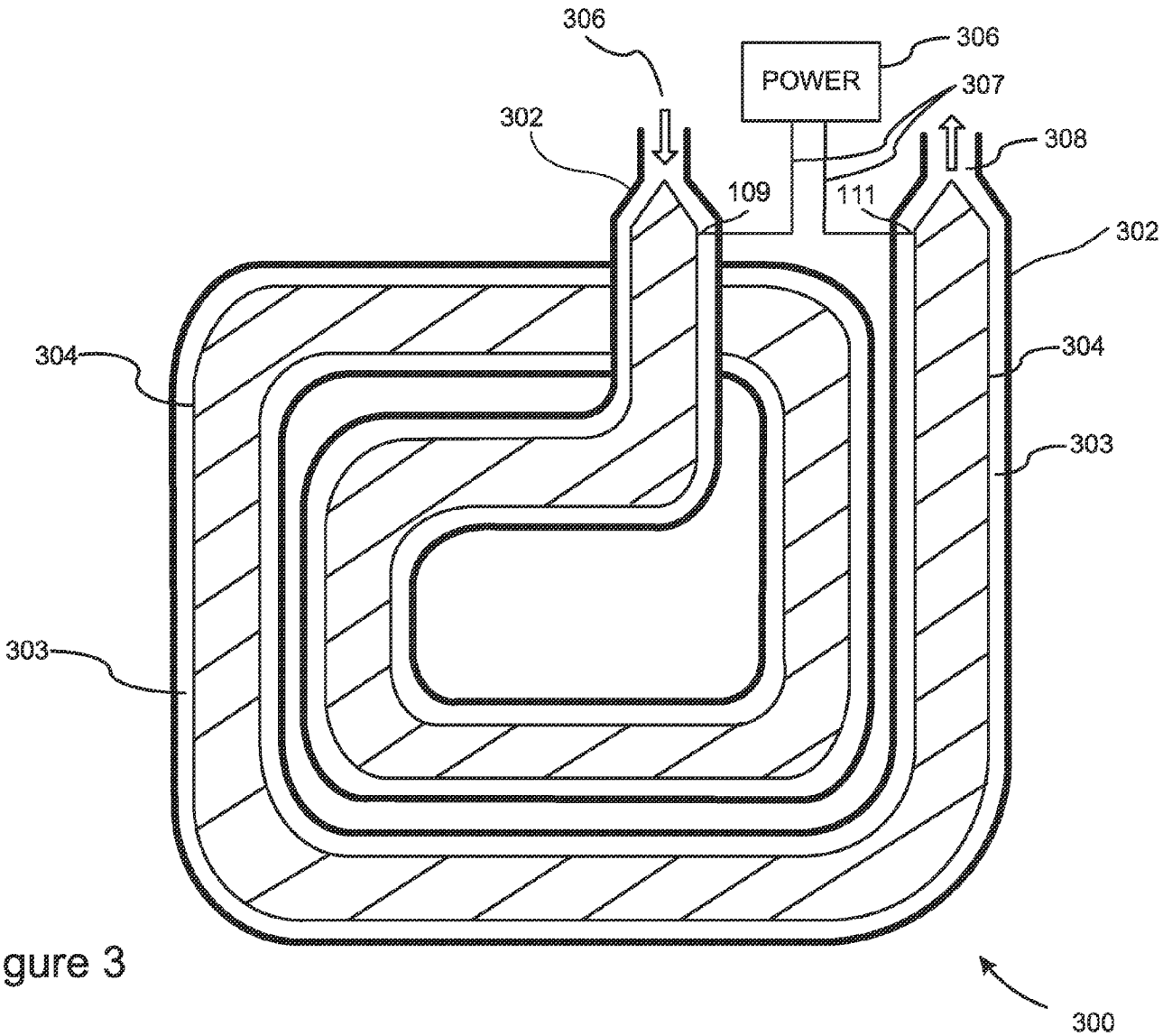
FIG. 3 is a side cross-sectional view of a water heater shaped as a spiral according to another embodiment of the present invention.

FIG. 3 illustrates another preferred embodiment 300 of the present invention that differs from the embodiments of FIG. 1A and FIG. 2 in that it has a general overall shape of a coil or spiral. However, the container 302 and the heating element contained therein 304 are otherwise similar to the embodiments of FIG. 1A and FIG. 2. The coil configuration of this embodiment 300 provides for a lengthier fluid passage 303 within a compact space, thereby increasing the heating capacity while occupying less space in the overall plumbing system. A power source 306 is connected by leads 307 to the heating element connectors 109, 111, which are located near each other, thereby minimizing the required lengths of the leads 307.

For simplicity of illustration, thermal insulation is not shown in FIG. 3 as surrounding the container 302. However, it will be understood that thermal insulation is included in some preferred embodiments that are otherwise identical to the embodiment of FIG. 3.

It will also be clear to those skilled in the art that the generally tubular configuration of FIG. 1A can be embodied in other shapes, such as S-shape, and that all such embodiments are included within the scope and spirit of the present invention.

Figure 4A:
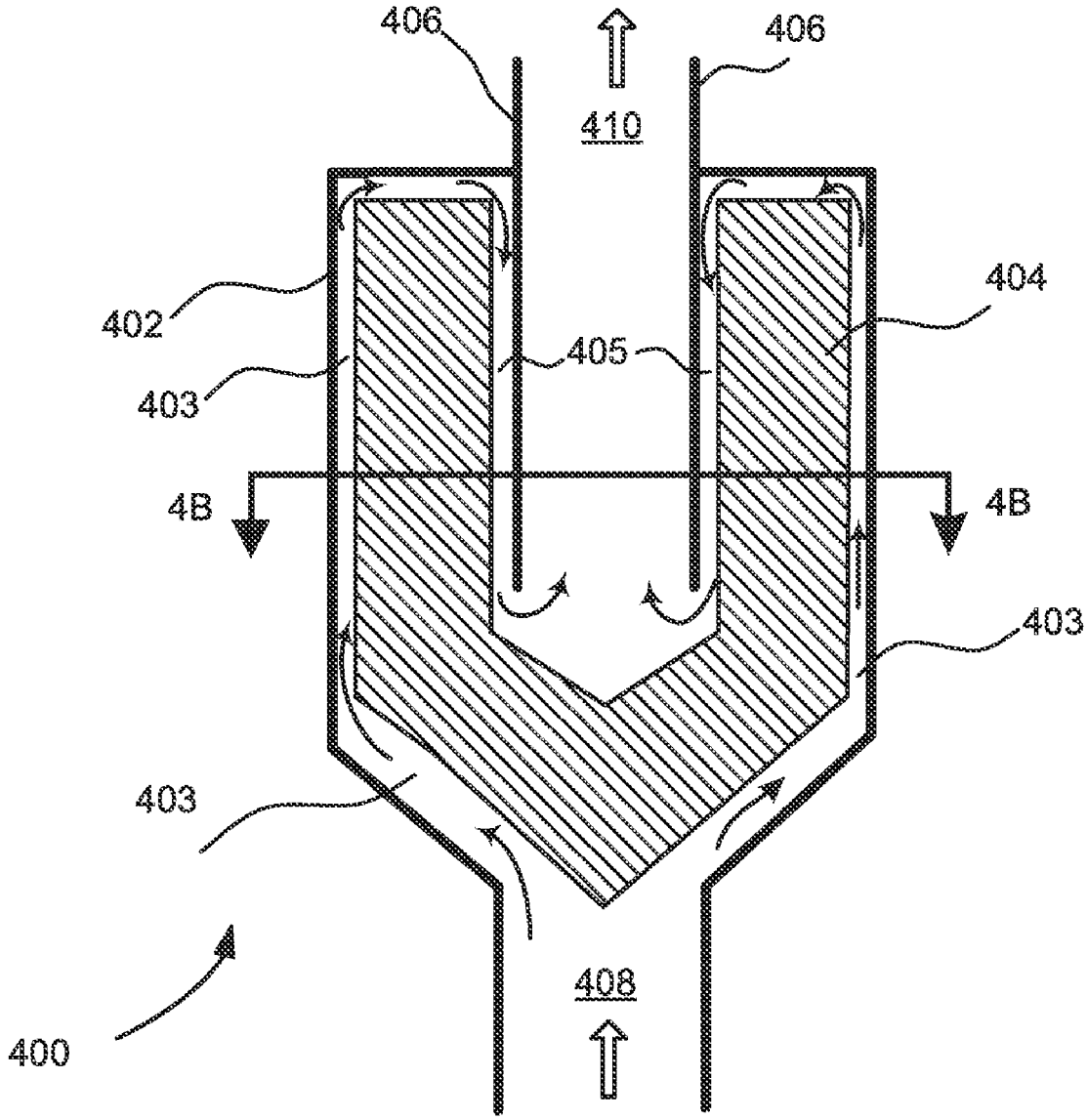
FIG. 4A is a side cross-sectional view of a water heater according to a counter-flow embodiment of the present invention.
Figure 4B:
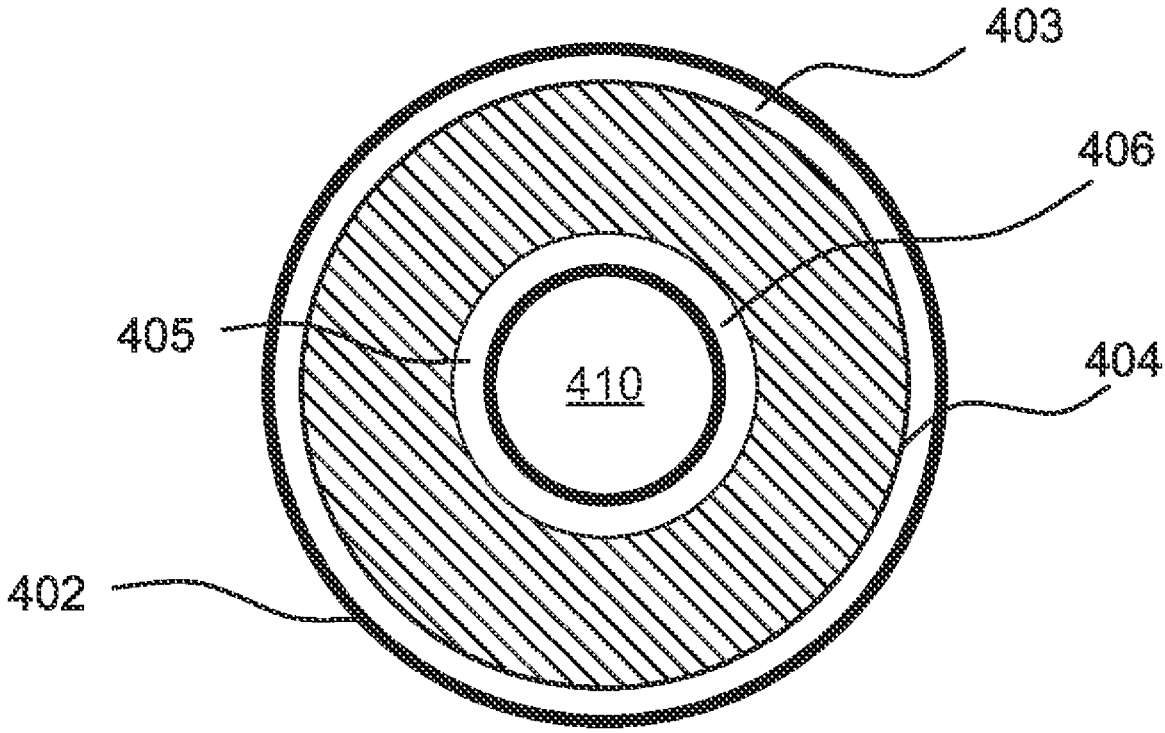
FIG. 4B is a top view of the water heater of FIG. 4A.

FIGS. 4A and 4B illustrate a side cross sectional view and a top view, respectively, of a tankless water heater 400 of the present invention according to a preferred embodiment that includes a cup-shaped flow through container 402 and heating element 404. In this embodiment, the fluid flows past the outer surface 403 of the heating element 404 in one direction, and then past the inner surface 405 of the heating element in the opposite direction. Thereafter, the fluid exits through a sleeve 406 and out of an outlet 410. The counter flow configuration of this embodiment provides a compact heater with a large area of contact between the fluid and the heating element 404. While utilizing a different geometry from the embodiments of FIGS. 1-3, the embodiment of FIG. 4 includes a heating element 404 with a surface that is everywhere in direct, unobstructed relationship with the walls of the container, and that is entirely surrounded by fluid maintained in close proximity with the surface while flowing through the heater 400 in a laminar flow. All of the fluid flowing through the container is forced to pass in close proximity to the heating element, and all of the heat emanating from the heating element 404 is required to pass through the fluid before escaping from the container 402.

The various embodiments of the present invention offer several advantages over the prior art. In each case, the heater has a simple design that reduces the cost of manufacture. Further, the present invention is energy efficient because all surfaces of the heating element are equally exposed to water, all of the water flowing through the container is forced to pass in close proximity to the heating element, and all heat emanating from the heating element must pass through the water before escaping from the container. Furthermore, the various embodiments described herein are compact in size due to enhanced heating efficiency and efficient geometries, and can therefore be easily installed into existing plumbing systems, typically at or near points of use.

Although references have been made throughout this specification to water as the fluid to be heated, it will be appreciated by those skilled in the art that any suitable fluid may be heated using embodiments of the present invention, and that all such obvious variations are included within the scope and spirit of the present invention.

It will also be appreciated that FIGS. 1-4 are not drawn to scale, but are rather intended to indicate the overall structure and features of the illustrated embodiments, and that wherever required, elements of the figures have been enlarged so as to clearly illustrate features residing therein.

Other modifications and implementations will occur to those skilled in the art without departing from the spirit and the scope of the invention as claimed. Accordingly, the above description is not intended to limit the invention except as indicated in the following claims.

What is claimed is:

1. An apparatus for heating a fluid as the fluid flows through a plumbing system, the plumbing system having a narrowest cross-sectional area, the apparatus comprising:

a flow-through container having an interior bounded by container walls, the flow-through container having an input and an output that are connectable to the plumbing system so as to allow the fluid to flow into the input, through the interior, and out of the output; and an electrically heated heating element contained within the flow-through container, the electrically heated heating element having a surface, each portion of the surface being in a directly facing and physically unobstructed relationship with a corresponding portion of the container walls, and creating therebetween a flow passage through which the fluid is required to flow in thermal contact with the surface of the electrically heated heating element.

2. The apparatus of claim 1, wherein the input and output are connectable to a water plumbing system.

3. The apparatus of claim 1, wherein the heating element has a proximal electrical connector at a proximal end of the heating element and a distal electrical connector at a distal end of the heating element, and the apparatus deviates from a linear configuration so as to position the proximal and distal ends closer to each other than the connectors would be if the apparatus were linear.

4. The apparatus of claim 1, wherein the space through which the flow passage has a width of not more than one-quarter inch.

5. The apparatus of claim 1, wherein the flow passage has a width of not more than one-eighth inch.

6. The apparatus of claim 1, wherein the flow-through container is configured as a hollow tube, and the heating element is configured as a rod centered concentrically within the hollow tube.

7. The apparatus of claim 6, wherein at least one section of the hollow tube is one of:

straight;

U-shaped;

S-shaped; and coiled.

8. The apparatus of claim 1, wherein the electrically heated heating element is substantially cup-shaped, having an inner surface and an outer surface, and the flow-through container surrounds the heating element so as to form a counter-flow configuration that causes the fluid to flow in opposite directions along the inner and outer surfaces of the electrically heated heating element.

9. The apparatus of claim 1 further comprising protrusions that extend outward from the heating element so as to increase thermal contact between the heating element and the fluid as the fluid flows through the flow-through container.

10. The apparatus of claim 9, wherein the protrusions are aligned with the fluid flow so as to minimize turbulence in the fluid flow.

11. The apparatus of claim 1, wherein a minimum cross sectional area of the flow passage is at least equal to the minimum cross-sectional area of the plumbing system.

12. The apparatus of claim 6, wherein at least one section of the hollow tube is one of:

straight;

U-shaped;

S-shaped; and coiled.

13. An apparatus for heating water as the water flows through a plumbing system, the plumbing system having a narrowest cross-sectional area, the apparatus comprising:

a flow-through container having an interior bounded by container walls, the flow-through container having an input and an output that are connectable to the plumbing system so as to allow the water to flow into the input, through the interior, and out of the output; and an electrically heated heating element contained within the flow-through container, the electrically heated heating element having a surface, each portion of the surface being in a directly facing and physically unobstructed relationship with a corresponding portion of the container walls, and creating therebetween a flow passage through which the water is required to flow in thermal contact with the surface of the electrically heated heating element.

14. The apparatus of claim 13, wherein the heating element has a proximal electrical connector at a proximal end of the heating element and a distal electrical connector at a distal end of the heating element, and the apparatus deviates from a linear configuration so as to position the proximal and distal ends closer to each other than the connectors would be if the apparatus were linear.

15. The apparatus of claim 13, wherein the space through which the flow passage has a width of not more than one-quarter inch.

16. The apparatus of claim 13, wherein the flow-through container is configured as a hollow tube, and the heating element is configured as a rod centered concentrically within the hollow tube.

17. The apparatus of claim 13, wherein the electrically heated heating element is substantially cup-shaped, having an inner surface and an outer surface, and the flow-through container surrounds the heating element so as to form a counter-flow configuration that causes the water to flow in opposite directions along the inner and outer surfaces of the electrically heated heating element.

18. The apparatus of claim 13 further comprising protrusions that extend outward from the heating element so as to increase thermal contact between the heating element and the water as the water flows through the flow-through container.

19. The apparatus of claim 13, wherein the protrusions are aligned with the water flow so as to minimize turbulence in the water flow.

20. The apparatus of claim 13, wherein a minimum cross sectional area of the flow passage is at least equal to the minimum cross-sectional area of the plumbing system.

* * * * *